US007144084B2

(12) United States Patent
Edwards et al.

(10) Patent No.: US 7,144,084 B2
(45) Date of Patent: Dec. 5, 2006

(54) CHAIR WITH ROD FRAME BACK ASSEMBLY

(75) Inventors: Tom Edwards, Spring Lake, MI (US); Errol Pearsons, Grand Haven, MI (US); Rick Rimer, Cincinnati, OH (US); Odie Eaves, Utica, KY (US); Brian Yeckering, Owensboro, KY (US); Gary Schmitt, Evansville, IN (US); John Stevens, Manitou, KY (US)

(73) Assignee: HNI Technologies Inc., Muscatine, IA (US)

( * ) Notice: Subject to any disclaimer, the term of this patent is extended or adjusted under 35 U.S.C. 154(b) by 101 days.

(21) Appl. No.: 10/854,384

(22) Filed: May 26, 2004

(65) Prior Publication Data

US 2005/0264084 A1 Dec. 1, 2005

(51) Int. Cl.
*A47C 7/02* (2006.01)

(52) U.S. Cl. ..... 297/452.18; 297/440.2; 297/411.24; 248/188.7

(58) Field of Classification Search ..... 297/452.18, 297/452.2, 440.2, 440.15, 411.2, 411.24, 297/463.1, 463.2; 248/188.1, 188.7, 188.9
See application file for complete search history.

(56) References Cited

U.S. PATENT DOCUMENTS 2,265,901 A * 12/1941 Greig ..... 297/452.11
3,604,752 A * 9/1971 Macknick ..... 297/452.53
3,617,023 A * 11/1971 Schneiderman ..... 248/188.7
4,580,840 A * 4/1986 Cunningham et al. . 297/452.18
4,588,228 A * 5/1986 Nemoto ..... 297/452.18
5,048,780 A * 9/1991 Borsani ..... 248/188.7
5,393,126 A * 2/1995 Boulva ..... 297/452.56
5,415,459 A * 5/1995 Schultz ..... 297/411.37
5,938,156 A * 8/1999 Kao ..... 248/188.7
5,964,463 A * 10/1999 Moore, Jr. ..... 273/274
6,113,186 A * 9/2000 Holmes et al. ..... 297/248
6,135,562 A * 10/2000 Infanti ..... 297/440.2
6,550,866 B1 * 4/2003 Su ..... 297/452.42
6,554,356 B1 * 4/2003 Crose ..... 297/216.13
6,572,194 B1 * 6/2003 True ..... 297/411.2
6,637,823 B1 * 10/2003 Ursini et al. ..... 297/440.2

* cited by examiner

*Primary Examiner*—Laurie K. Cranmer
(74) *Attorney, Agent, or Firm*—Faegre & Benson LLP

(57) ABSTRACT

A chair having a metal rod frame back assembly where the frame includes generally horizontal top, bottom and middle members and spaced apart generally vertical side members. Two seat brackets are welded to the middle and bottom members and attach to a seat board and two rod segments are welded to the side members. The seat board is covered with foam and upholstery. The back frame may be covered with springy mesh to give a thin elegant, yet comfortable back structure. Alternatively, foam is glued to a structural material and the material and foam combination and the frame are covered with upholstery. Arms and armrests are attached to the seat board and the seat and back assemblies with arms are mounted to a pedestal connected to a five spoke base riding on casters.

17 Claims, 4 Drawing Sheets

CHAIR WITH ROD FRAME BACK ASSEMBLY

CROSS REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates to a chair with a simple back assembly and more particularly to a simply constructed chair with a rod frame back assembly which is easy to assemble and allows stylistic variations.

2. Description of the Related Art

Chairs, especially office chairs, have many different designs and constructions which offer consumers a very wide variety from which to choose. Generally, such chairs must have certain characteristics, such as seat height adjustment, the ability to swivel and a back tilt feature. Beyond these characteristics, chairs must meet certain comfort levels and aesthetic qualities which are typically subjective to chair users. Cost is also an important factor and it is a combination of these elements which chair designers attempt to meet.

BRIEF SUMMARY OF THE INVENTION

What is described here is a chair having a back assembly including a frame of metal rod having a top member, side members, a bottom member, a middle member, two brackets and first and second rod segments.

There are a number of advantages, features and objects achieved with the present invention which are believed not to be available in earlier related devices. For example, the chair of the present invention is simply constructed, very strong and very versatile. The chair is also easy to assemble, relatively inexpensive and achieves a highly contemporary look.

A complete understanding of the present invention and other objects, advantages and features thereof will be gained from a consideration of the present specification which provides a written description of the invention, and the manner and process of making and using the invention, set forth in such full, clear, concise, and exact terms as to enable any person skilled in the art to which it pertains, or with which it is most nearly connected, to make and use the same in compliance with Title 35 U.S.C. section 112 (first paragraph). Furthermore, the following description of preferred embodiments of the invention read in conjunction with the accompanying drawing provided herein represents examples of the invention, but the invention itself is defined by the Claims attached hereto.

DETAILED DESCRIPTION OF THE PREFERRED EMBODIMENTS OF THE INVENTION

Figure 1:
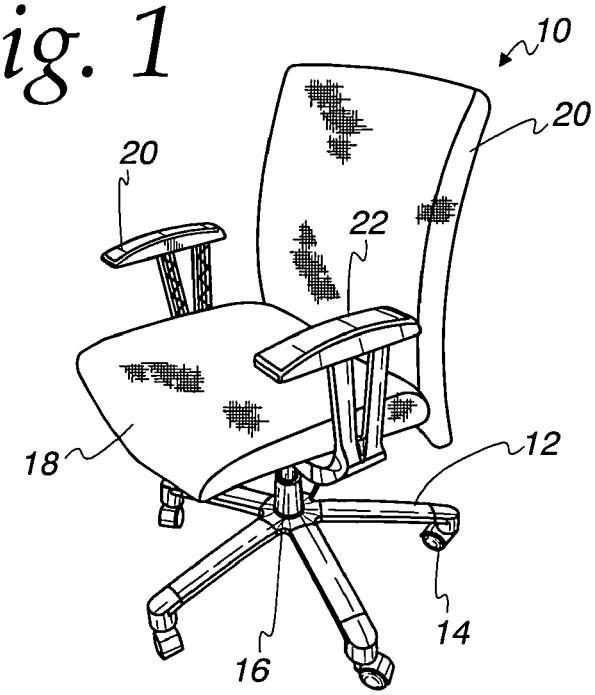
FIG. 1 is a front isometric view of an office chair with the below described back assembly.

While the present invention is open to various modifications and alternative constructions, the preferred embodiments illustrating the best mode contemplated by the inventors of carrying out their invention are shown in the various figures of the drawing and will be described herein in detail pursuant to Title 35 U.S.C. section 112 (first paragraph). It is understood, however, that there is no intention to limit the invention to the particular embodiments, forms or examples which are disclosed herein. To the contrary, the intention is to cover all modifications, equivalent structures and methods, and alternative constructions falling within the spirit and scope of the invention as expressed in the appended Claims section that concludes the present specification, the claims particularly pointing out and distinctly claiming the subject matter which applicants regard as their invention, pursuant to Title 35 U.S.C. section 112 (second paragraph).

Figure 2:
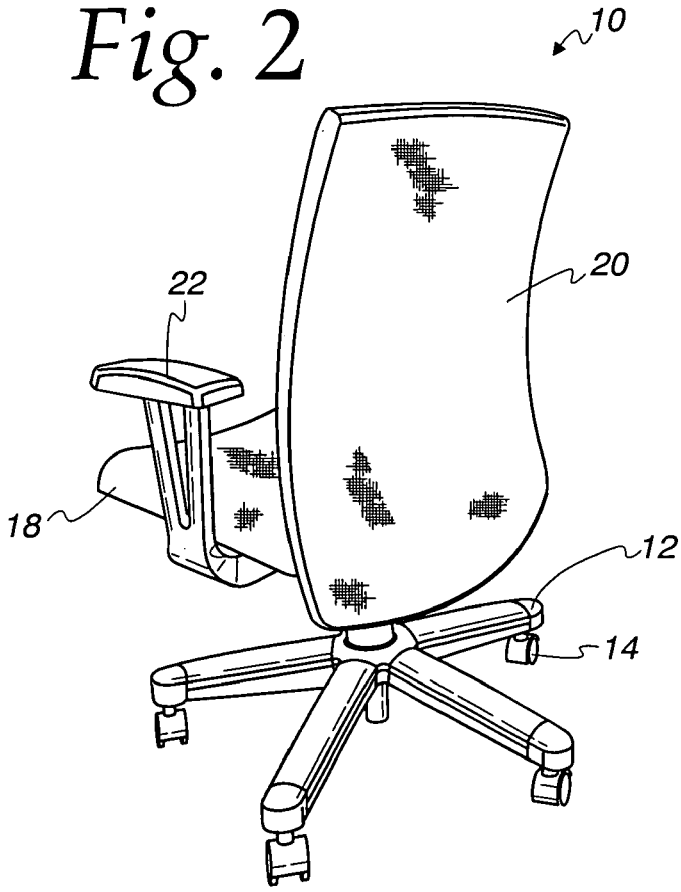
FIG. 2 is a rear isometric view of the office chair shown in FIG. 1.
Figure 3:
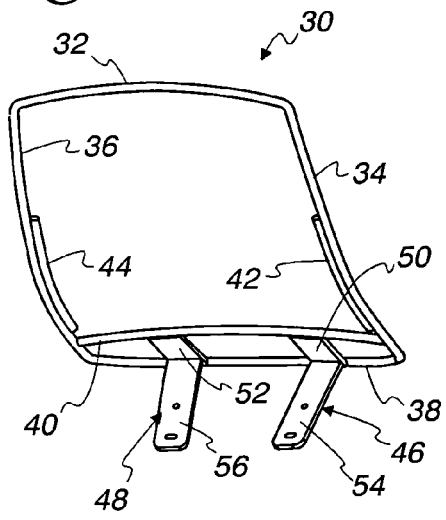
FIG. 3 is a front isometric view of a back frame assembly for the office chair shown in FIGS. 1 and 2.

The beauty, elegance and simplicity of the invented chair is illustrated by reference to FIGS. 1 and 2 illustrating a swivel type office chair 10 having a five spoke base 12 with casters 14, an adjustable pedestal 16, a seat assembly 18, a back assembly 20 and a pair of arms/armrests 22, 24 The office chair includes a pneumatic gas cylinder and swivel tilt control, both well know among those skilled in the art.

Referring to FIGS. 3–6, the back assembly of the chair includes a steel rod frame 30, the frame including a generally horizontal top rod member 32, left and right generally vertical side rod members 34, 36, and a laterally extending bottom rod member 38. Attached by welding to the left and right side members is a middle generally horizontal rod member 40 spaced from the bottom member 38 but extending laterally similar to the bottom member.

Welded to the left and right side members are two rod segments 42, 44 which are aligned, front and back, with the side members 34, 36. The rod segments strengthen the frame and provide sufficient stiffness to give the most desirable flexibility to the frame when stressed by a chair user's weight.

The top, bottom and side members of the frame may be formed of one integral rod which is bent to the configuration shown and welded closed. The preferred diameter of the rods is about one-half inch.

Welded flush with the bottom member 38 and the middle member 40 are two brackets 46, 48. The brackets each include a generally vertical plate 50, 52 and a generally horizontal plate 54, 56.

Figure 4:
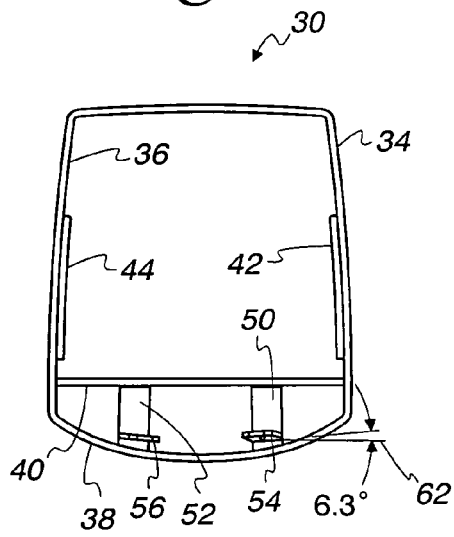
FIG. 4 is a front elevation view of the back frame assembly.
Figure 5:
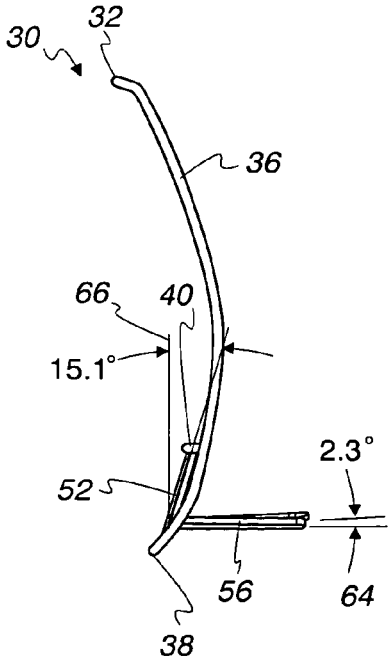
FIG. 5 is a right side elevation view of the back frame assembly.

As can be seen in FIG. 5, the side members 34, 36 and rod segments 42, 44 have a forward arcuate or bowed configuration in elevation view. The top member 32 includes an upwardly directed slightly arcuate shape in both front and side elevation views, FIGS. 4 and 5, and rearwardly directed arcuate shape in top plan view, FIG. 6. The middle member 40 has a rearwardly directed bowed or arcuate configuration in top plan view, FIG. 6, while the bottom member 38 is bowed downwardly, FIG. 4, and slightly rearwardly, FIG. 6.

The shape of the back assembly is graceful and elegant, thin or narrow, easy to fabricate and relatively inexpensive. The structure is also strong yet stylistically versatile.

Figure 6:
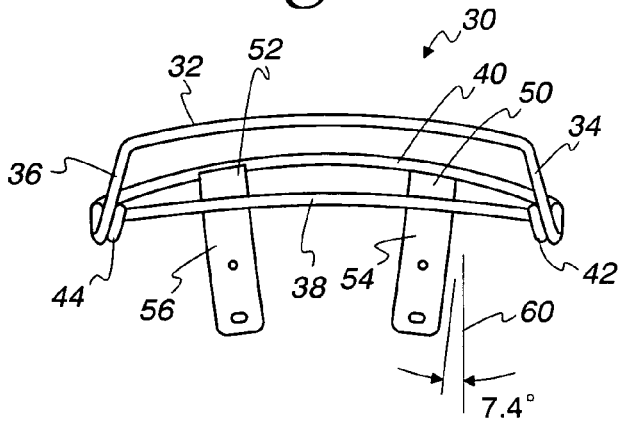
FIG. 6 is a top plan view of the back frame assembly.

Referring again to FIGS. 3–6, the horizontal seat bracket plates 54, 56 are welded to the vertical plates 50, 52 so as to extend in a generally horizontal direction away from the vertical plates and away from the frame members. The horizontal seat bracket plates converge toward one another at an angle of about 7.4 degrees (yaw angle) from a longitudinal horizontal reference line 60 as shown in FIG. 6 and are slightly slanted at an angle of about 6.3 degrees (roll angle) from a lateral horizontal reference line 62 as shown in FIG. 4. Although the seat bracket plates extend generally horizontally, they are slightly oblique, extending upwardly at about an angle of about 2.3 degrees (pitch angle) from a longitudinal horizontal reference line 64 as shown in FIG. 5.

The side members are initially bowed at a bottom angle of about 15.1 degrees from a vertical reference line 66 as shown in FIG. 5. It has been found that these various angles provide ergonomic comfort to a user of the chair after fabric material is added as will be explained herein below. The back frame will also have a slight flex in response to a user's shifting of body weight.

Referring again to FIGS. 1 and 2, a seat board (not directly shown) is attached to the seat brackets and suitable cushion material such as foam and upholstery may be added to provide the desired comfort and pleasing appearance for a user.

Figure 7:
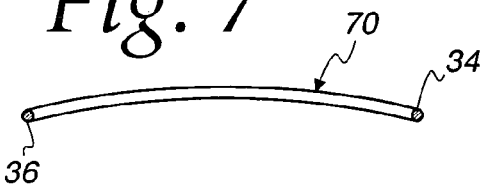
FIG. 7 is a diagrammatic sectional plan view of the back frame assembly covered with tensile fabric.
Figure 8:
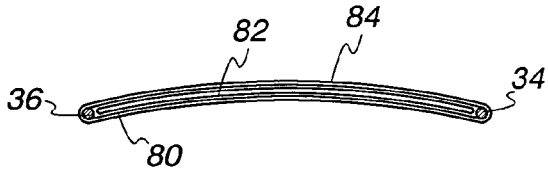
FIG. 8 is a diagrammatic sectional plan view of the back frame assembly covered with tensile fabric, foam and upholstery as also shown in FIGS. 1 and 2.

Shown in FIGS. 7 and 8 are two embodiments of coverings on the back frame. The embodiment shown in FIG. 7 illustrates a tensile fabric sock 70 stretched across the frame from side member 34 to side member 36. The fabric is a springy mesh type material that gives an elegant curved, very thin profile appearance and provides a springy feel for comfort. The material is woven and breathable which adds to its comfort by dissipating body heat. The other embodiment is shown in FIG. 8 and illustrates the same frame but a different covering. Placed around the frame side members 34, 36 is a structural material 80. This material is woven polypropylene having flexibility. Foam material 82 is glued to the structural material and upholstery material 84, such as fabric or leather, covers the frame, the structural material and the foam. Such upholstered chair backs give similar comfort found in mesh type backs but with the color and design flexibility of upholstered construction. An example of structural material is sold under the SPRINGTEX brand, available from Matrex of Greensboro, N.C. Lumbar support is achieved by frame shape and the fabric material in both embodiments.

The simple, yet strong, construction of the back allows for freedom of design while still providing a maximum of chair user comfort. The chair just described also allows such design features as wood inserts in the armrests, as well as in the base. These give the chair a warm, rich appearance. Other insert material may be used for color coordination, for example, or for a specific texture.

Figure 9:
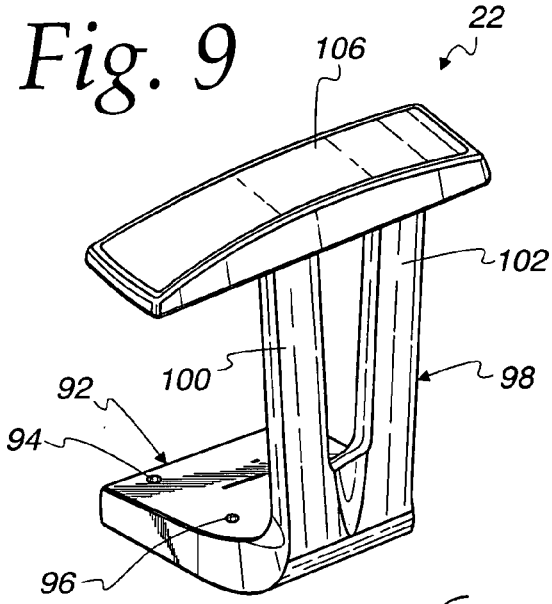
FIG. 9 is an isometric view of a chair arm and an armrest.
Figure 10:
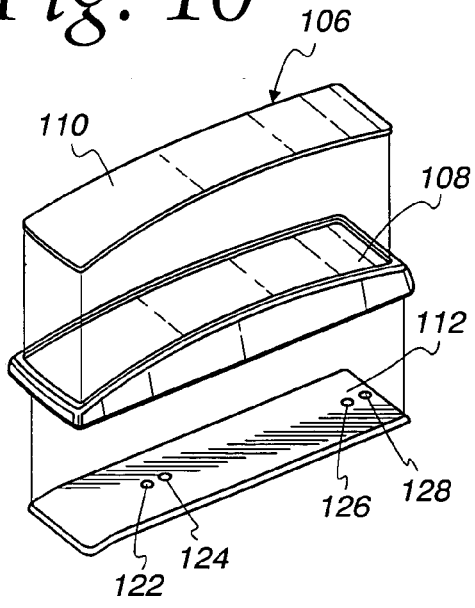
FIG. 10 is an exploded isometric view of the armrest.
Figure 11:
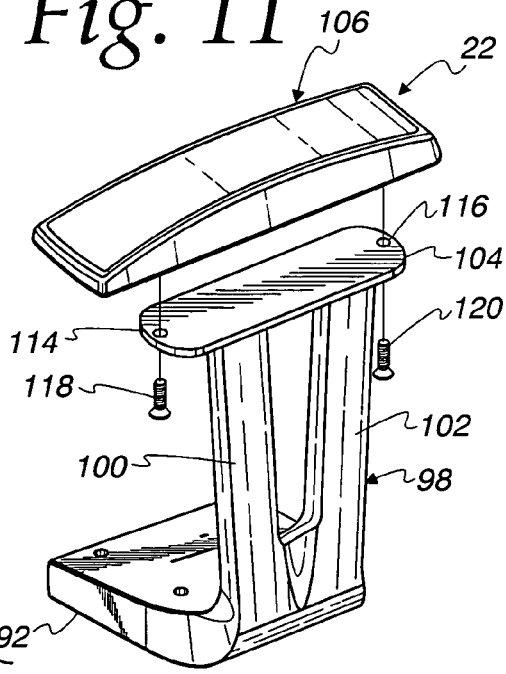
FIG. 11 is an exploded isometric view of the chair arm and the armrest.

The chair arms and armrests 22,24 are constructed of a molded L-shaped plastic support 90, FIGS. 9–11. The L-shaped support includes a plate-like bottom portion 92 with fastener holes 94, 96 to attach to the seat board. The support upper portion 98 is formed in a V-shape with two arms 100, 102 and an armrest plate 104. Mounted to the armrest plate is an armrest 106 formed of a molded urethane pad 108, a wood insert 110 and a steel base pad 112. The armrest plate 104 includes fastener openings 114, 116 to receive screws 118, 120 to attach to the base pad 112 which also includes fastener openings 122, 124, 126, 128.

Figure 12:
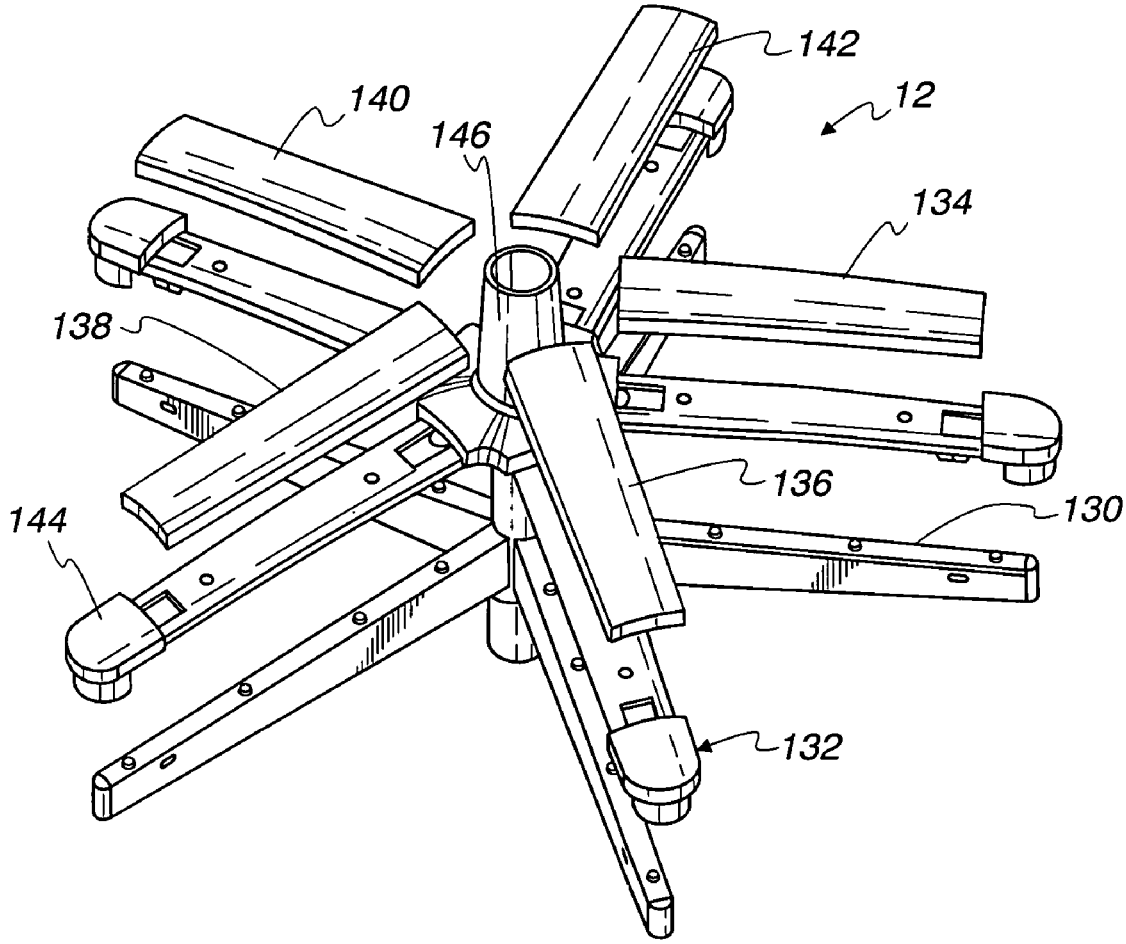
FIG. 12 is an exploded isometric view of a chair base.

The bottom support of the chair is the five spoke base 12 and includes a steel substructure or frame 130, FIG. 12, a one piece plastic cap 132 and wood inserts 134, 136, 138, 140, 142. The plastic cap includes toe caps, such as toe cap 144, which protect the inserts from damage. The toe caps also coordinate visually with the mounted casters 14, FIG. 1. The plastic cap also includes an integral hub portion 146. The wood inserts are fastened to the plastic cap with screws (not shown) and the plastic cap is attached to the steel frame with metal clips (not shown). Other inserts besides wood may be used to coordinate with the arm inserts. Other bottom supports may be used besides a five spoke base. For example, a four legged frame may be used to form a non-swivel guest chair structure Assembly of the chair is quick and easy. For example, the five spoke base is assembled by attaching the inserts to the cap and the cap to the substructure. The armrest is assembled by attaching the insert to the urethane pad and the pad to the armrest base pad. The armrest is then attached to the armrest plate of the arm. A seat board is covered with foam and upholstery and then attached to the brackets of the back frame. Thereafter, a mesh fabric sock is placed over the frame and the chair is completed by attaching the arms to the seat board. The combination seat and back assemblies and the base are connected to the vertically adjustable pedestal. In a second embodiment, the back frame is covered with a structural material to which foam is glued. That combination is then covered with upholstery.

The resulting chairs are visually lighter than the typical office or guest chair to aesthetically fit today's tighter offices and yet still provide full seat comfort. Two alternative backs are provided, tailored fabric upholstery and breathable tensile mesh fabric.

The above specification describes in detail several preferred embodiments of the present invention. Other examples, embodiments, modifications and variations will, under both the literal claim language and the doctrine of equivalents, come within the scope of the invention defined by the appended claims. For example, using the different materials for either or both the seat and the back assemblies will still result in an equivalent structure. Other cushioning material besides foam may be used. Yet other alternatives will also be equivalent as will many new technologies. There is no desire or intention here to limit in any way the application of the doctrine of equivalents nor to limit or restrict the scope of the invention as defined by the attached Claims.

The invention claimed is:

1. A chair having a back assembly comprising:

a frame of metal rod including a top member, generally vertical left and right side members, a bottom member, a middle member and left and right segments, said middle member being attached to said left and said right side members and spaced below said top member and above said bottom member and said left and right segments being attached to said left and right side members for stiffening said frame, wherein said bottom member of said frame is bowed downwardly and rearwardly; and two seat brackets attached to said bottom member and to said middle member, said seat brackets extending outwardly from said frame.

2. The chair as claimed in claim 1 wherein:

said left and said right side members are bowed forwardly.

3. The chair as claimed in claim 1 where:

said top member and said middle member are bowed rearwardly.

4. The chair as claimed in claim 3 wherein:

said left and said right side members are bowed forwardly.

5. The chair as claimed in claim 1 wherein:

said brackets each include a generally vertical plate extending between said middle member and said bottom member, and a generally horizontal plate extending outwardly at an acute angle from a reference longitudinal line.

6. The chair as claimed in claim 5 wherein:

said horizontal plate is angled at an acute angle from a reference lateral line.

7. The chair as claimed in claim 6 wherein:

said frame is covered with a structural material.

8. The chair as claimed in claim 6 wherein:

said frame is covered with a structural material to which foam is adhered and upholstery covers said frame, said structural material and said foam.

9. The chair as claimed in claim 1 wherein:

said frame is covered with a structural material.

10. The chair as claimed in claim 1 wherein:

said frame is covered with a structural material to which foam is adhered and upholstery covers said frame, said structural material and said foam.

11. A chair comprising:

a bottom support;

a seat assembly;

and a back assembly, said back assembly including a frame of metal rod including a top member, generally vertical left and right side members, a bottom member, a middle member and left and right segments, said middle member being attached to said left and said right side members and spaced below said top member and above said bottom member and said segments being attached to said left and right side members, wherein said left and said right side members are bowed forwardly, said bottom member of said frame is bowed downwardly and rearwardly, and said top member and said middle member are bowed rearwardly; and two seat brackets attached to said bottom member and to said middle member, said seat brackets extending outwardly from said frame.

12. The chair as claimed in claim 11 wherein:

said brackets each include a generally vertical plate extending between said middle member and said bottom member, and a generally horizontal plate extending outwardly at an acute angle from a reference longitudinal line.

13. The chair as claimed in claim 12 wherein:

said frame is covered with a structural material.

14. The chair as claimed in claim 12 wherein:

said frame is covered with a structural material to which foam is adhered and upholstery covers said frame, said structural material and said foam.

15. The chair as claimed in claim 11 including:

a pair of arms, each of said arms having a molded plastic L-shaped support and a three part armrest, said armrest having a molded base, an insert protected by said molded base, and a metal substructure.

16. The chair as claimed in claim 11 wherein:

said bottom support including a metal base having a plurality of spokes, a plastic cap including toe caps and a plurality of decorative inserts mounted to and protected by said plastic cap.

17. The chair as claimed in claim 16 including:

a pair of arms, each of said arms having a molded plastic L-shaped support and a three part armrest, said armrest having a molded base, an insert protected by said molded base, and a metal substructure.

* * * * *